US010349165B2

(12) United States Patent
Cao

(10) Patent No.: US 10,349,165 B2
(45) Date of Patent: Jul. 9, 2019

(54) LOUDSPEAKER MODULE

(71) Applicant: Goertek Inc., Weifang (CN)

(72) Inventor: Xiaodong Cao, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 15/566,606

(22) PCT Filed: Dec. 9, 2015

(86) PCT No.: PCT/CN2015/096756
§ 371 (c)(1),
(2) Date: Oct. 13, 2017

(87) PCT Pub. No.: WO2016/165355
PCT Pub. Date: Oct. 20, 2016

(65) Prior Publication Data

US 2018/0132035 A1 May 10, 2018

(30) Foreign Application Priority Data

Apr. 13, 2015 (CN) ..... 2015 2 0221184 U

(51) Int. Cl.
*H04R 1/02* (2006.01)
*H04R 1/28* (2006.01)
*H04R 31/00* (2006.01)

(52) U.S. Cl.
CPC ..... *H04R 1/2803* (2013.01); *H04R 1/02* (2013.01); *H04R 1/288* (2013.01); *H04R 31/006* (2013.01); *H04R 2499/11* (2013.01)

(58) Field of Classification Search
CPC ..... H04R 1/2819; H04R 1/02; H04R 1/288; H04R 1/2803; H04R 31/006; H04R 31/00; H04R 2499/11
(Continued)

(56) References Cited

U.S. PATENT DOCUMENTS

2013/0170687 A1* 7/2013 Papakyriacou ..... B01J 20/18 381/338
2017/0289672 A1* 10/2017 Yang ..... H04R 1/22

FOREIGN PATENT DOCUMENTS

CN 104202703 A * 12/2014 ..... H04R 1/22
CN 104202703 A 12/2014
(Continued)

OTHER PUBLICATIONS

International Bureau of WIPO, International Search Report and Written Opinion in Application No. PCT/CN2015/096756 dated Mar. 3, 2016.

*Primary Examiner* — Yogeshkumar Patel
(74) *Attorney, Agent, or Firm* — LKGlobal | Lorenz & Kopf, LLP

(57) ABSTRACT

A loudspeaker module, comprising a housing, the housing accommodates a loudspeaker unit, and the loudspeaker unit divides the overall module inner cavity into a front acoustic cavity and a rear acoustic cavity, the rear acoustic cavity is provided with sound absorbing particles therein, the rear acoustic cavity is further provided with therein a net-like isolating component for isolating the sound absorbing particles and the loudspeaker unit, the isolating component divides the whole rear acoustic cavity into a filled region and an non-filled region, the sound absorbing particles are located within the filled region, the sound absorbing particles are made of a non-foaming material, and the external diameter of the sound absorbing particles is ≥0.01 mm and less than the height of the filled region.

10 Claims, 4 Drawing Sheets

(58) Field of Classification Search
USPC ..... 381/345
See application file for complete search history.

(56) References Cited

FOREIGN PATENT DOCUMENTS

| | | | | |
|---|---|---|---|---|
| CN | 203984671 | U | * | 12/2014 |
| CN | 203984671 | U | | 12/2014 |
| CN | 204131714 | U | | 1/2015 |
| CN | 204180268 | U | | 2/2015 |
| CN | 204498347 | U | | 7/2015 |
| CN | 103098490 | B | | 6/2016 |

* cited by examiner

LOUDSPEAKER MODULE

CROSS-REFERENCE TO RELATED APPLICATION

This application is a U.S. National-Stage entry under 35 U.S.C. § 371 based on International Application No. PCT/CN2015/096756, filed Dec. 9, 2015, which was published under PCT Article 21(2) and which claims priority to Chinese Patent Application No. 201520221184.4, filed Apr. 13, 2015, which are all hereby incorporated herein in their entirety by reference.

TECHNICAL FIELD

This Application pertains to the technical field of electroacoustic products, and particularly relates to a loudspeaker module.

BACKGROUND

The loudspeaker module is an important acoustic component in portable electronic devices. As an energy conversion device, it is used to complete the conversion between an electrical signal and an acoustic signal. A conventional loudspeaker module generally comprises a housing accommodating a loudspeaker unit, and the loudspeaker unit divides the whole inner cavity of the module into a front acoustic cavity and a rear acoustic cavity. In order to reduce the F0 (low frequency) of the module and widen the band width, a sound absorption element is often provided in the rear acoustic cavity. The sound absorption element can effectively reduce the F0 of the module, and makes the medium frequency curve smoother, and is an important component in loudspeaker modules. The effect of the sound absorption element in the rear acoustic cavity directly depends on the filling amount of the sound absorption element in the rear acoustic cavity, and it can significantly improve the performance of loudspeaker modules to fill the rear acoustic cavity as much as possible with the sound absorption element.

Since the space of the rear acoustic cavity of loudspeaker modules is limited, and the material and sound absorbing effect of the packaging materials are insufficient to meet the demands on the acoustic performance, sound absorbing cotton cannot be placed into rear vocal cavities as the sound absorption element. Presently, technicians usually package zeolite particles with a screen mesh cloth into a packaging bag as the sound absorption element. However, the packaging bag will be limited by the shape and size of the rear acoustic cavity and cannot fill the whole rear acoustic cavity. Additionally, the overall gas permeability of the packaging bag is poor, which severely affects the utilizing of the sound absorption performance of the zeolite particles, and thereby the packaging bag sound absorption element cannot satisfy the demands on the expected acoustic performance of the products. In addition, other objects, desirable features and characteristics will become apparent from the subsequent summary and detailed description, and the appended claims, taken in conjunction with the accompanying drawings and this background.

SUMMARY

The technical problem that the present application seeks to solve is to provide a loudspeaker module, the sound absorbing material of the loudspeaker module can fill the rear acoustic cavity to the largest extent, the sound absorption performance of the sound absorbing material can be sufficiently utilized, and the acoustic performance of the product is good, the process is simple, and the cost is low.

In order to solve the above technical problems, the technical solution of the present application is:

a loudspeaker module, comprising a housing, the housing accommodating a loudspeaker unit, and the loudspeaker unit dividing the overall module inner cavity into a front acoustic cavity and a rear acoustic cavity, wherein the rear acoustic cavity is provided with sound absorbing particles therein, the rear acoustic cavity is further provided with therein a net-like isolating component for isolating the sound absorbing particles and the loudspeaker unit, the isolating component divides the whole rear acoustic cavity into a filled region and an non-filled region, the sound absorbing particles are located within the filled region, the sound absorbing particles are made of a non-foaming material, and the external diameter of the sound absorbing particles is ≥0.01 mm and less than the height of the filled region.

Optionally, the isolating component is provided within the rear acoustic cavity longitudinally, the housing is provided with a filling hole that communicates with the filled region, and the outer side of the filling hole is covered by a sealing element.

Optionally, the housing comprises an upper housing, a middle housing and a lower housing joined together, the isolating component is provided between the middle housing and the lower housing, and the middle housing, the lower housing and the isolating component jointly enclose to form the filled region.

Optionally, clipping slots are provided respectively at the positions on the middle housing and the upper housing that correspond to the isolating component are provided with a clipping slot, and the isolating component is clipped in the clipping slots.

Optionally, the housing comprises an upper housing, a middle housing and a lower housing joined together, the isolating component is provided between the middle housing and the lower housing, and the upper housing, the middle housing, the lower housing and the isolating component jointly enclose to form the filled region.

Optionally, the isolating component is provided within the rear acoustic cavity laterally, the housing comprises an upper housing, a middle housing and a lower housing joined together, the isolating component is fixed to the middle housing, and the isolating component, the upper housing and the middle housing jointly enclose to form the filled region.

Optionally, a filling hole that communicates with the filled region is provided on the upper housing or the isolating component, and the outer side of the filling hole is covered by a sealing element.

Optionally, a plastic cement frame is provided at the periphery of the isolating component, and the plastic cement frame and the middle housing are integrally joined by ultrasonic welding process.

Optionally, the isolating component is one of a screen mesh cloth and a metal net sheet, or a laminate composite of a screen mesh cloth and a steel net.

Optionally, the non-foaming material is one of natural zeolite powder, white carbon black, activated carbon and molecular sieve, or is a mixture of at least two of natural zeolite powder, white carbon black, activated carbon and molecular sieve.

By employing the above technical solutions, the present application can achieve the following advantageous effects:

In the loudspeaker module of the present application, the rear acoustic cavity of is provided with the sound absorbing particles therein, and is further provided with the net-like isolating component for isolating the sound absorbing particles and the loudspeaker unit; the isolating component divides the rear acoustic cavity into the filled region and the non-filled region; the sound absorbing particles are located within the filled region; the sound absorbing particles are made of a non-foaming material; and the external diameter of the sound absorbing particles is ≥0.01 mm and less than the height of the filled region. In such a technical solution, the sound absorbing particles are directly filled into the rear acoustic cavity of the module, so the sound absorbing particles are not restrained by the shape of the rear acoustic cavity and can fully fill the rear acoustic cavity, and can utilize the volume of the rear acoustic cavity to the largest extent to contain the most sound absorbing particles, and prevents the limitation on the filling of the sound absorbing particles by the irregular shapes of the rear acoustic cavity of the loudspeaker module. The overall gas permeability of the sound absorbing particles is smoother without the packaging by screen mesh cloth, which can more effectively utilize the sound absorption performance of the sound absorbing particles. The pore paths of the sound absorbing particles can greatly enlarge the volume of the rear acoustic cavity, which can effectively adjust the low frequency performance of the module and widen the transmission bands. In addition, the sound absorbing particles and the rear acoustic cavity of the module cling more tightly, which greatly improves the acoustic performance of the module. Additionally, the technical solutions of the present application, compared with the prior art, save the step of packaging the sound absorbing particles and reduce the difficulty of assembling, save a large amount of devices, materials and molds for packaging the sound absorbing particles, and effectively decrease the number of workers, save the labor, and reduce the production cost.

In conclusion, the loudspeaker module of the present application solves the technical problem in the prior art that the sound absorption performance of the sound absorbing particles in the rear acoustic cavity of the loudspeaker module is not sufficiently utilized. The loudspeaker module of the present application can fill the rear acoustic cavity with the sound absorbing particles to the largest extent, and sufficiently utilizes the sound absorption performance of the filling sound absorbing particles. The acoustic performance of the product is good, the production efficiency is high and the production cost is low.

BRIEF DESCRIPTION OF THE DRAWINGS

The present invention will hereinafter be described in conjunction with the following drawing figures, wherein like numerals denote like elements, and.

Figure 1:
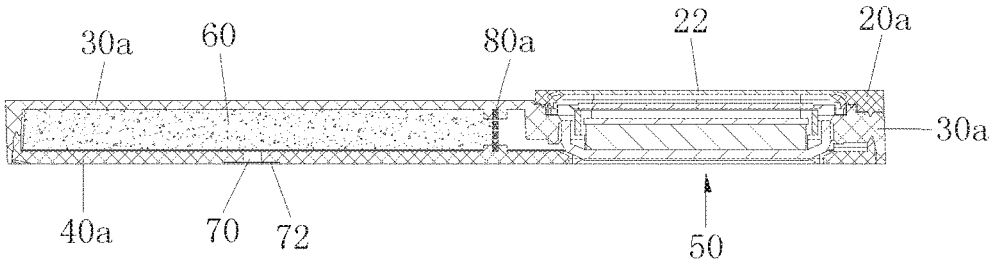
FIG. 1 is the sectional view of the first embodiment of the loudspeaker module of the present application.

In the drawings: 20*a*, upper housing; 20*b*, upper housing; 20*c*, upper housing; 20*d*, upper housing; 22, steel sheet; 30*a*, middle housing; 30*b*, middle housing; 30*d*, middle housing; 30*e*, middle housing; 40*a*, lower housing; 40*b*, lower housing; 40*c*, lower housing; 40*d*, lower housing; 50, loudspeaker unit; 60, sound absorbing particles; 70, filling hole; 72, sealing element; 80*a*, isolating component; 80*b*, isolating component; 82, steel net; 84, screen mesh cloth; 86, connection portion; 88, plastic cement frame; 90, strip-like protrusions; and 92, clipping slots.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The present application will be further illustrated below by referring to the drawings and the embodiments.

The directions "upper" mentioned in the description all refer to the direction of the vibrating system of the loudspeaker unit, and the directions "down" all refer to the direction of the magnetic circuit system of the loudspeaker unit. The locations "inner side" mentioned in the description all refer to the side that is within the module inner cavity, and the locations "outer side" all refer to the side that is out of the module inner cavity.

First Embodiment

Figure 2:
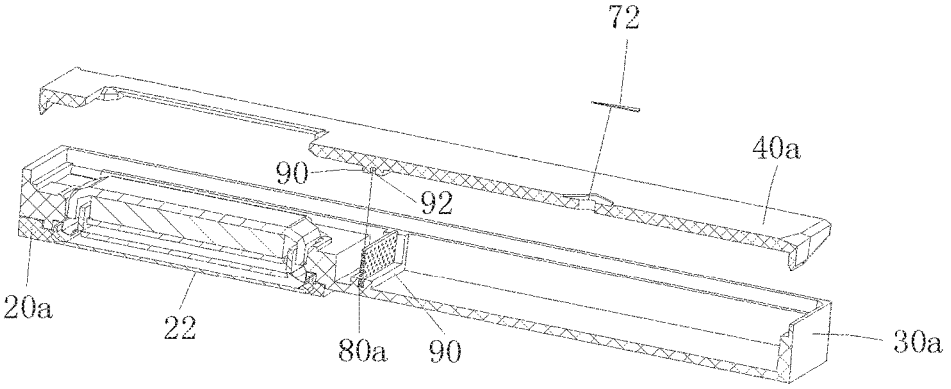
FIG. 2 is the sectional exploded view of the first embodiment of the loudspeaker module of the present application.

As shown jointly by FIG. 1 and FIG. 2, the loudspeaker module is of an elongated structure, comprising a housing formed by an upper housing 20*a*, a middle housing 30*a* and a lower housing 40*a* joined together, the space enclosed by the upper housing 20*a*, the middle housing 30*a* and the lower housing 40*a* accommodates a loudspeaker unit 50, and the loudspeaker unit 50 is located at one end of the module. The loudspeaker unit 50 divides the overall module inner cavity into a front acoustic cavity and a rear acoustic cavity, and the loudspeaker unit 50 and the upper housing 20*a* jointly enclose to form the front acoustic cavity. The loudspeaker unit 50, the middle housing 30*a* and the lower housing 40*a* jointly enclose to form the rear acoustic cavity, and the rear acoustic cavity is provided with sound absorbing particles 60 therein, and is further provided with an isolating component 80*a* for isolating the sound absorbing particles 60 and the loudspeaker unit 50. The isolating component 80*a* is longitudinally provided between the middle housing 30*a* and the lower housing 40*a* adjacent to the side of the loudspeaker unit 50, and divides the whole rear acoustic cavity into a filled region and a non-filled region, and the middle housing 30*a*, the lower housing 40*a* and the isolating component 80*a* jointly enclose to form the filled region. The isolating component 80*a* is a net-like structure, which can facilitate the circulation of gas flow between the filled region and the non-filled region. The sound absorbing particles 60 are located within the filled region, and the lower half of the loudspeaker unit 50 is located within the non-filled region.

Figure 3:
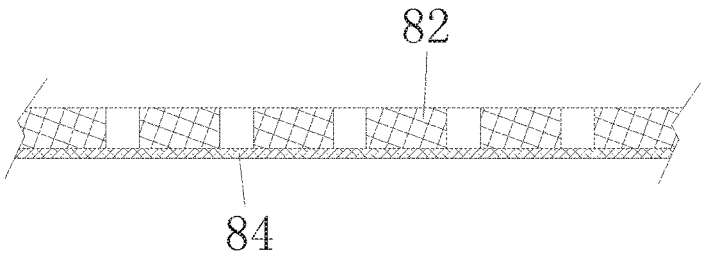
FIG. 3 is the schematic diagram of the structure of the isolating component of FIG. 1.

As shown jointly by FIG. 1 and FIG. 2, clipping slots 92 are provided respectively at the positions on the internal surfaces of the middle housing 30*a* and the lower housing 40*a* that correspond to the isolating component 80*a*. The clipping slots 92 are formed by two strip-like protrusions 90 that are parallelly provided on the inner sides of the middle housing 30*a* and the lower housing 40*a*, and the gaps between the two strip-like protrusions 90 are the clipping slots 92. The strip-like protrusions 90 that are located on the inner side of the middle housing 30*a* form an integral structure with the middle housing 30*a*; the strip-like protrusions 90 that are located on the inner side of the lower housing 40*a* form an integral structure with the lower housing 40*a*; they are all formed by direct injection molding during the injection molding of the housing. The periphery of the isolating component 80*a* is clipped in the clipping slots 92. The isolating component 80*a* may be a screen mesh cloth, a metal net sheet and so on, or a laminate composite of a screen mesh cloth and a steel net. In the present embodiment, preferably, the isolating component 80*a* is a composite formed by laminating a screen mesh cloth 84 and a steel net 82 into one piece. As shown in FIG. 3, the steel net 82 supports the screen mesh cloth 84, which can prevent the deformation of the screen mesh cloth 84 by the squeezing of the sound absorbing particles.

As shown jointly by FIG. 1 and FIG. 2, on the lower housing 40*a*, a filling hole 70 that communicates the filled region and the exterior of the module is provided at the position that corresponds to the filled region. The end of the filling hole 70 that is located at the outer side of the lower housing 40*a* is covered by a sealing element 72. The sealing element 72 is a damper type elastic pad, and is adhered to the lower housing 40*a* by using back glue or directly spreading glue. The filling hole may also be provided on the middle housing 30*a*.

As shown in FIG. 1, the sound absorbing particles 60 are formed by the granulation of a non-foaming material and an adhesive agent. The non-foaming material includes natural zeolite powder, white carbon black, activated carbon or molecular sieve, or the mixture of at least two of these materials mixed in a certain ratio. However, it is not limited to these materials, and these materials are preferable materials in the present embodiment. The maximum external diameter of the sound absorbing particles is ≥0.01 mm, and less than the maximum height of the filled region of the rear acoustic cavity. The pore diameter of the isolating component 80*a* is 0.01 mm-1 mm, and the pore diameter of the isolating component should be chosen according to the external diameter of the filling sound absorbing particles, to ensure that the pore diameter of the isolating component is less than the external diameter of the sound absorbing particles.

As shown in FIG. 2, during filling the sound absorbing particles, first, the isolating component 80*a* is inserted into the clipping slot 92 on the middle housing 30*a*, then the clipping slot 92 of the lower housing 40*a* is aligned with the isolating component 80*a* to clip to the middle housing 30*a*, and then the middle housing 30*a* and the lower housing 40*a* are joined integrally by ultrasonic welding process. After the middle housing 30*a* and the lower housing 40*a* are joined, the sound absorbing particles are filled into the filled region via the filling hole 70, and after the filling is completed the sealing element 72 is adhered to the lower housing 40*a* to cover the filling hole 70, and the sealing of the rear acoustic cavity is completed.

As shown jointly by FIG. 1 and FIG. 2, a steel sheet 22 is formed at the position of the upper housing 20*a* that corresponds to the loudspeaker unit 50 by injection molding. The steel sheet 22 protects the loudspeaker unit 50 and increases the space of the front acoustic cavity to the largest extent, so that the gas flow circulation in the front acoustic cavity is smoother.

As shown jointly by FIG. 1 and FIG. 2, a mounting hole is provided at the position of the lower housing 40*a* that corresponds to the loudspeaker unit 50. After the assembling of the module is completed, the lower surface of the loudspeaker unit 50 can flush with the outer surface of the lower housing 40*a*, which effectively reduces the overall height of the module, and is better to satisfy the demands of thinning tendency.

Second Embodiment

Figure 4:
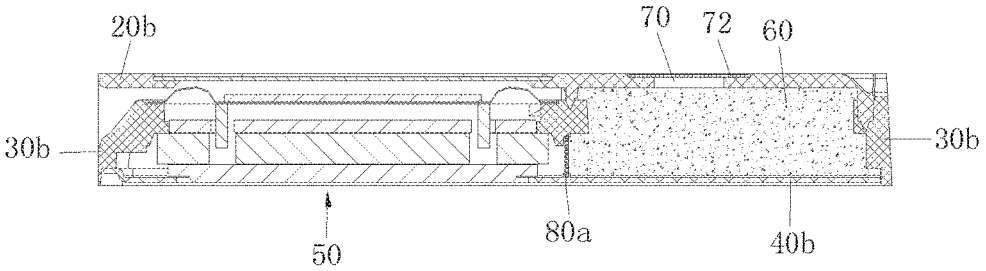
FIG. 4 is the sectional view of the second embodiment of the loudspeaker module of the present application.
Figure 5:
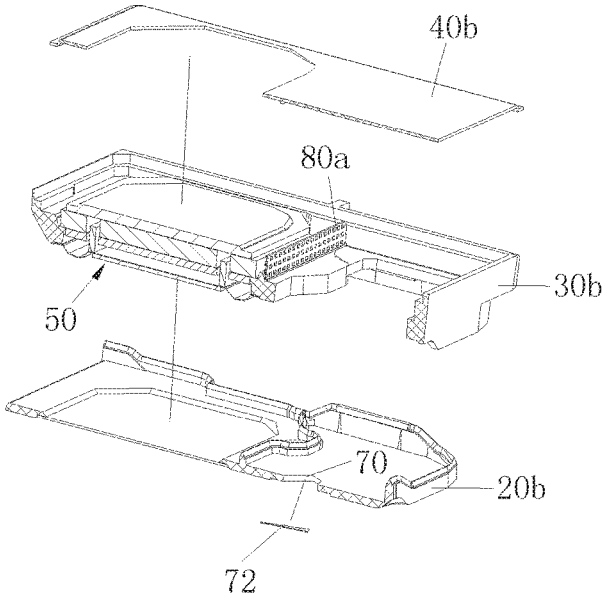
FIG. 5 is the sectional exploded view of the second embodiment of the loudspeaker module of the present application.

The present embodiment is basically the same as the first embodiment, and the differences are as follows:

As shown jointly by FIG. 4 and FIG. 5, the housing comprises an upper housing 20*b*, a middle housing 30*b* and a lower housing 40*b* joined together; the upper housing 20*b*, the middle housing 30*b*, the loudspeaker unit 50 and the lower housing 40*b* jointly enclose to form the rear acoustic cavity; the upper housing 20*b*, the middle housing 30*b*, the isolating component 80*a* and the lower housing 40*b* jointly enclose to form the filled region of the rear acoustic cavity. The upper housing 20*b* and the middle housing 30*b* join by ultrasonic welding process. The isolating component 80*a* is provided between the middle housing 30*b* and the lower housing 40*b* longitudinally. The isolating component 80*a* may be fixed to the middle housing 30*b* and the lower housing 40*b* by injection molding, using back glue or spreading glue, etc. On the upper housing 20*b*, a filling hole 70 is provided at the position that corresponds to the filled region, and the end of the filling hole 70 that is located on the outer side of the upper housing 20*b* is covered by a sealing element 72.

Third Embodiment

Figure 6:
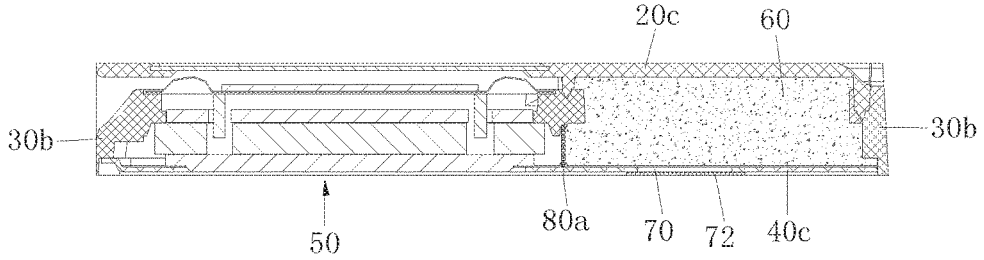
FIG. 6 is the sectional view of the third embodiment of the loudspeaker module of the present application.

The present embodiment is basically the same as the second embodiment, and the differences are as follows:

As shown in FIG. 6, the housing comprises an upper housing 20*c*, a middle housing 30*b* and a lower housing 40*c* joined together; the upper housing 20*c*, the middle housing 30*b*, the loudspeaker unit 50 and the lower housing 40*c* jointly enclose to form the rear acoustic cavity; the upper housing 20*c*, the middle housing 30*b*, the isolating component 80*a* and the lower housing 40*c* jointly enclose to form the filled region of the rear acoustic cavity. The lower housing 40*c* is provided with a filling hole 70, and the end of the filling hole 70 that is located on the outer side of the lower housing 40*c* is covered by a sealing element 72.

Fourth Embodiment

Figure 7:
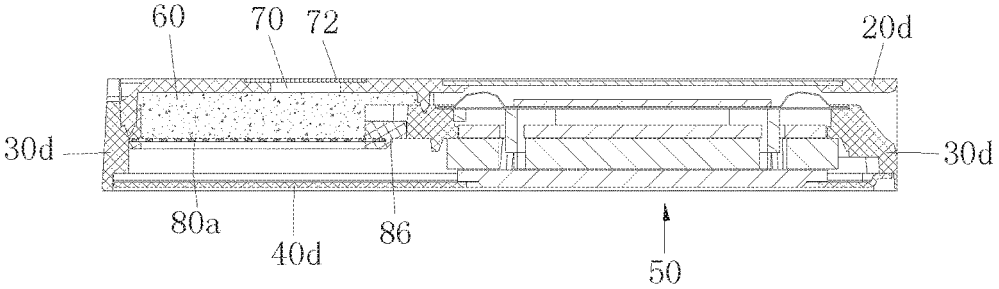
FIG. 7 is the sectional view of the fourth embodiment of the loudspeaker module of the present application.
Figure 8:
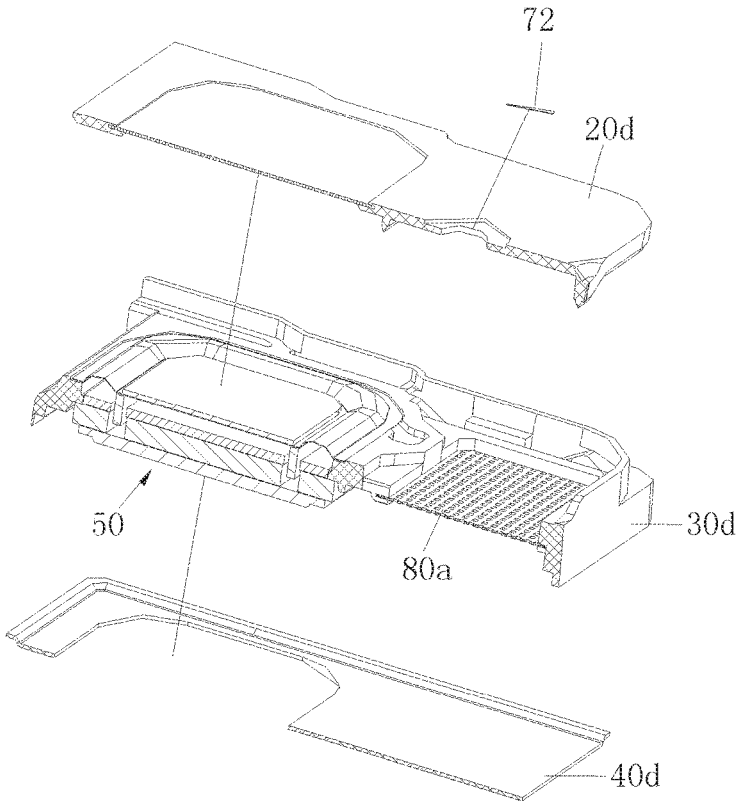
FIG. 8 is the sectional exploded view of the fourth embodiment of the loudspeaker module of the present application.

The present embodiment is basically the same as the second embodiment, and the differences are as follows:

As shown jointly by FIG. 7 and FIG. 8, the isolating component 80*a* is provided within the rear acoustic cavity laterally, the isolating component 80*a* is arranged parallelly with an upper housing 20*d* and a lower housing 40*d*, and is fixed to a middle housing 30*d* by a connection portion 86. The upper housing 20*d*, the middle housing 30*d* and the isolating component 80*a* enclose to form a filled region. The upper housing 20*d* is provided with a filling hole 70, and the end of the filling hole 70 that is located on the outer side of the upper housing 20*d* is covered by a sealing element 72.

The connection portion 86 may be plastic cement or adhesive paste. If the connection portion 86 is plastic cement, the isolating component 80*a* is injection-molded onto the connection portion 86, and then the connection portion 86 is adhered to the middle housing 30*d*. If the connection portion 86 is adhesive paste, the isolating component 80*a* may be directly adhered to the middle housing 30*d*. The connection portion 86 may also be part of the middle housing 30*d*, and the isolating component 80*a* is directly injection molded onto the middle housing 30*d* during the injection molding of the middle housing 30*d*.

Fifth Embodiment

Figure 9:
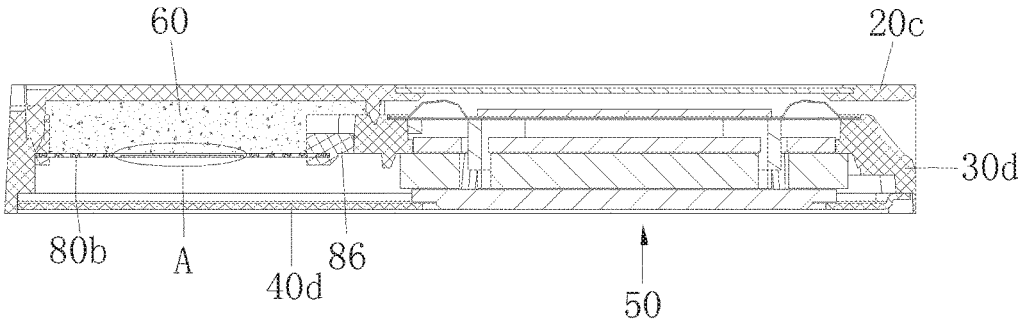
FIG. 9 is the sectional view of the fifth embodiment of the loudspeaker module of the present application.
Figure 10:
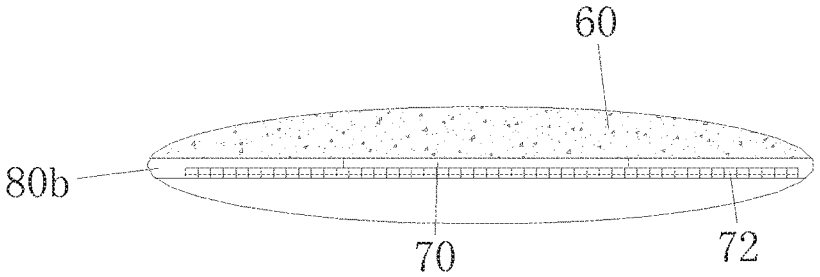
FIG. 10 is the enlarged view of the part A of FIG. 9.

The present embodiment is basically the same as the fourth embodiment, and the differences are as follows:

As shown jointly by FIG. 9 and FIG. 10, the filling hole 70 is provided on an isolating component 80*b*, and the sealing element 72 is adhered to the side of the isolating component 80*b* that is adjacent to the lower housing 40*d*.

During filling the sound absorbing particles, first, the isolating component 80*b* is fixed to the middle housing 30*d*, then the upper housing 20*c* and the middle housing 30*d* are joined integrally by ultrasonic welding process, then the sound absorbing particles are filled into the filled region via the filling hole 70 on the isolating component 80*b*, after the filling is completed the sealing element 72 is adhered to the isolating component 80*b* to cover the filling hole 70, and finally the lower housing 40*d* and the middle housing 30*d* are sealingly joined integrally, thereby completing the sealing of the rear acoustic cavity.

Sixth Embodiment

Figure 11:
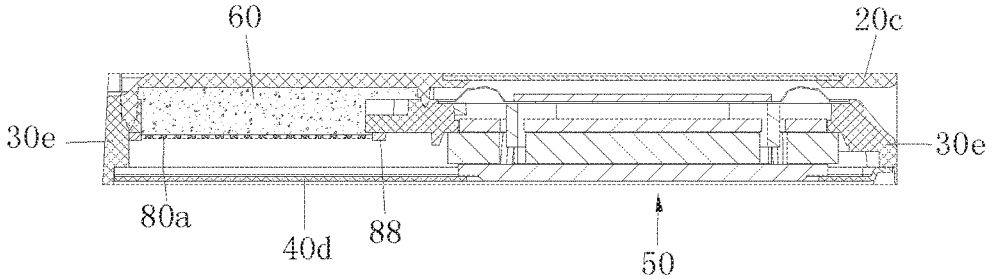
FIG. 11 is the sectional view of the sixth embodiment of the loudspeaker module of the present application.
Figure 12:
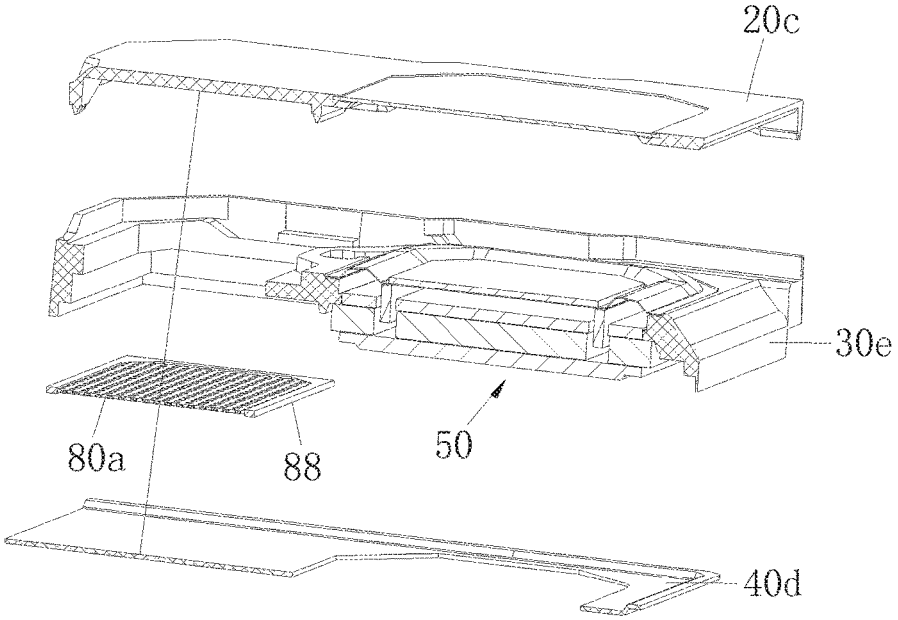
FIG. 12 is the sectional exploded view of the sixth embodiment of the loudspeaker module of the present application.

The present embodiment is basically the same as the fifth embodiment, and the differences are as follows:

As shown jointly by FIG. 11 and FIG. 12, a plastic cement frame 88 is provided at the periphery of the isolating component 80*a*, and the plastic cement frame 88 and a middle housing 30*e* are joined by ultrasonic welding process, thereby fixing the isolating component 80*a* to the middle housing 30*e*. In the present embodiment, neither of the upper housing 20*c* and the isolating component 80*a* is provided with a filling hole.

During filling the sound absorbing particles, first, the upper housing 20*c* and the middle housing 30*e* are joined integrally by ultrasonic welding process, then the sound absorbing particles are filled into the filled region, after the filling is completed the plastic cement frame 88 is fixed to the middle housing 30*e* by ultrasonic welding process, to complete the sealing of the filled region, and finally the lower housing 40*d* and the middle housing 30*e* are sealingly joined integrally, thereby completing the sealing of the rear acoustic cavity.

The above six embodiments of the present application are merely illustrations of the technical solutions of the present application wherein the sound absorbing particles are filled dispersedly into the filled region of the rear acoustic cavity and are isolated from the loudspeaker unit by the isolating component, and the present application is not limited to the six embodiments. Additionally, the structure of the loudspeaker module is not limited to the above structures, and the technical solutions of the present application can be applied to any modules that are required to provide sound absorbing particles within a rear acoustic cavity. Therefore, no matter whether the structure of the loudspeaker module is the same as that of the present application, and no matter whether the structures and the installing modes of the isolating component are the same as those in the above embodiments, all of the products that sound absorbing particles are filled dispersedly into the filled region of the rear acoustic cavity and are isolated from the loudspeaker unit by an isolating component, to improve the sound absorption effect of the sound absorbing particles and the acoustic performance of the module, shall fall within the protection scope of the present application.

The present application is not limited to the above special embodiments. Diverse variations made by a person skilled in the art from the above idea without paying creative work shall all fall within the protection scope of the present application.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A loudspeaker module, comprising a housing, the housing accommodating a loudspeaker unit, and the loudspeaker unit dividing the overall module inner cavity into a front acoustic cavity and a rear acoustic cavity, wherein the rear acoustic cavity is provided with sound absorbing particles therein, the rear acoustic cavity is further provided with therein a net-like isolating component for isolating the sound absorbing particles and the loudspeaker unit, the isolating component divides the whole rear acoustic cavity into a filled region and a non-filled region, the sound absorbing particles are filled dispersedly within the filled region, the sound absorbing particles are made of a non-foaming material, and the external diameter of the sound absorbing particles is ≥0.01 mm and less than the height of the filled region, a pore diameter of the isolating component is less than a minimum external diameter of the sound absorbing particles.

2. The loudspeaker module according to claim 1, wherein the isolating component is provided within the rear acoustic cavity longitudinally, the housing is provided with a filling hole that communicates with the filled region, and the outer side of the filling hole is covered by a sealing element.

3. The loudspeaker module according to claim 2, wherein the housing comprises an upper housing, a middle housing and a lower housing joined together, the isolating component is provided between the middle housing and the lower housing, and the middle housing, the lower housing and the isolating component jointly enclose to form the filled region.

4. The loudspeaker module according to claim 3, wherein clipping slots are provided respectively at the positions on the middle housing and the upper housing that correspond to the isolating component, and the isolating component is clipped in the clipping slots.

5. The loudspeaker module according to claim 2, wherein the housing comprises an upper housing, a middle housing and a lower housing joined together, the isolating component is provided between the middle housing and the lower housing, and the upper housing, the middle housing, the lower housing and the isolating component jointly enclose to form the filled region.

6. The loudspeaker module according to claim 1, wherein the isolating component is provided within the rear acoustic cavity laterally, the housing comprises an upper housing, a middle housing and a lower housing joined together, the isolating component is fixed to the middle housing, and the isolating component, the upper housing and the middle housing jointly enclose to form the filled region.

7. The loudspeaker module according to claim 6, wherein a filling hole that communicates with the filled region is provided on the upper housing or the isolating component, and the outer side of the filling hole is covered by a sealing element.

8. The loudspeaker module according to claim 6, wherein a plastic cement frame is provided at the periphery of the isolating component, and the plastic cement frame and the middle housing are integrally joined by ultrasonic welding process.

9. The loudspeaker module according to claim 1, wherein the isolating component is one of a screen mesh cloth and a metal net sheet, or a laminate composite of a screen mesh cloth and a steel net.

10. The loudspeaker module according to claim 1, wherein the non-foaming material is one of natural zeolite powder, white carbon black, activated carbon and molecular sieve, or is a mixture of at least two of natural zeolite powder, white carbon black, activated carbon and molecular sieve.

* * * * *